US007726435B2

(12) United States Patent
Nakayoshi et al.

(10) Patent No.: US 7,726,435 B2
(45) Date of Patent: Jun. 1, 2010

(54) CONSTRUCTION MACHINE

(75) Inventors: Takanobu Nakayoshi, Hiroshima (JP); Hirokazu Imashige, Hiroshima (JP); Tomohiko Asakage, Hiroshima (JP); Kazuyuki Takeda, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 375 days.

(21) Appl. No.: 11/764,640

(22) Filed: Jun. 18, 2007

(65) Prior Publication Data

US 2008/0005937 A1 Jan. 10, 2008

(30) Foreign Application Priority Data

Jul. 5, 2006 (JP) ..... 2006-185386
Sep. 28, 2006 (JP) ..... 2006-265695

(51) Int. Cl.
*E02F 9/22* (2006.01)

(52) U.S. Cl. ..... 180/315; 180/336

(58) Field of Classification Search ..... 180/89.1, 180/89.12, 315, 326, 327, 333, 336; 296/190.01, 296/190.08, 193.07; *B60K 28/00, 28/04*
See application file for complete search history.

(56) References Cited

U.S. PATENT DOCUMENTS 7,134,519 B2 11/2006 Imashige et al.
7,530,418 B2 * 5/2009 Ishii et al. ..... 180/89.12
2009/0166117 A1 * 7/2009 Hokimoto ..... 180/89.12

FOREIGN PATENT DOCUMENTS

| | | | |
|---|---|---|---|
| JP | 2000-96626 | | 4/2000 |
| JP | 2000-160600 | | 6/2000 |
| JP | 2000-213003 | | 8/2000 |
| JP | 2002-82730 | | 3/2002 |
| JP | 2002-227249 | | 8/2002 |
| JP | 2004-124503 | | 4/2004 |
| JP | 2006-016853 | * | 7/2004 |
| JP | 2005-284892 | | 10/2005 |

* cited by examiner

*Primary Examiner*—Paul N Dickson
*Assistant Examiner*—Jordan Golomb
(74) *Attorney, Agent, or Firm*—Oblon, Spivak, McClelland, Maier & Neustadt, L.L.P.

(57) ABSTRACT

In a hydraulic excavator wherein a control valve unit having a plurality of control valves in a united form and an operation pattern switching valve for switching from one to another among combined patterns of operating valves and control valves are disposed side by side in front and rear positions respectively within a valve accommodating space formed between an upper frame base plate and a floor plate in an upper rotating body, the operation pattern switching valve is inclined forwardly downward in a state in which its upper surface side including an operating lever thereof faces an operation port being formed to the floor plate.

4 Claims, 5 Drawing Sheets

CONSTRUCTION MACHINE

BACKGROUND OF THE INVENTION

1. Field of the Invention

The present invention relates to a construction machine such as a hydraulic excavator equipped with an operation pattern switching valve.

2. Description of the Related Art

There is known a hydraulic excavator equipped with an operation pattern switching valve for selecting a combination pattern of both operating valve and control valve from among plural such combination patterns in accordance with the desire of an operator.

The switching valve is installed under a floor near the operator's feet sitting on an operator's seat. An upper frame of an upper rotating body is composed of a base plate and a floor plate disposed spacedly over the base plate. A small aperture called an operation port is formed in the floor plate and an operating lever is operated through the small aperture. Therefore, it is necessary to install the operating lever in a state permitting easy operation thereof from the operation port.

On an upper surface of the switching valve a switching position is indicated using a cast letter or a sticker. For confirming that position it is desirable that as wide an area as possible on the upper surface side be easily visible from the operation port.

However, a large control valve unit is installed in a valve accommodating space and occupies most of the same, including a unit base, port and accessory pipes, so that the switching valve is compelled to be disposed behind the control valve unit and is installed at an inner position below a seat frame.

In this case, since the switching valve is installed perpendicularly to the base plate, its upper surface side also lies in the inner position.

On the other hand, since it is necessary to ensure a support portion for supporting a rear end portion of a floor mat laid over the floor plate, the operation port is formed in a position spaced a suitable distance forward from the seat frame.

As a result, since the whole of the switching valve is positioned fairly rearwards of the operation port, the operator is required to insert his or her hand backward through the operation port in a forcibly bowed state while looking at the inner side and is then required to operate an operating lever projecting slightly from the operation port. Thus, there has been the problem that not only it is very difficult to operate the operating lever, but also the indication of the switching position is difficult to see and it is difficult to check the position.

There also has been the problem that water sprinkled over the switching valve when washing the machine body is apt to stagnate on the upper surface of the switching valve, especially on a sealing member and a mounted portion thereof, and hence rusting is apt to occur.

The following measures are proposed against such problems.

(i) Disposing the switching valve just under the operation port (ahead of the present position) in a state in which a part of the valve overlaps the upper surface of the control valve unit.

(ii) Disposing the switching valve in a state in which its upper portion projects to the upper surface side of the floor plate, as disclosed in Japanese Patent Laid Open No. 2002-227249.

(iii) Installing the switching valve horizontally in the transverse direction at the present position and forming an operation port in a side face of the upper frame.

However, in the case of a small-sized hydraulic excavator whose height is limited, it is impossible to expand the valve accommodating space upward and hence the proposal (i) is unadoptable.

According to the proposal (ii), not only it is necessary to use an additional part for covering the projecting portion of the operating pattern switching valve, but also the projecting portion is an obstacle to washing the machine body. Further, the space near the operator's feet is reduced. Thus, the proposal (ii) is not advisable.

The proposal (iii) is not practical because not only it becomes difficult for the operator to perform operations but also it is necessary to provide a special lid for opening and closing the operation port.

Since an underfloor space is formed also on the right side between the upper frame base plate and the floor plate, the control valve unit or the switching valve can be displaced to the said right-hand underfloor space. Also in this case, however, the switching valve is still compelled to be installed in an inner position of the underfloor space. For example, this is because a swing cylinder for swinging a working attachment right and left is installed in front the switching valve. Thus, such displacement of the switching valve is not a solution to the foregoing problems.

SUMMARY OF THE INVENTION

It is an object of the present invention to provide a construction machine which, under the situation of an operation pattern switching valve being compelled to be installed in an underfloor space near the right or left foot of an operator, permits a switching operation of the switching valve and confirmation of a switching position of the same valve to be done easily without compulsion, and suppress the water collecting over the switching valve.

The construction machine of the present invention has the following basic configuration.

The construction machine of the present invention is equipped with a lower traveling body and an upper rotating body mounted on the lower traveling body rotatably about a vertical axis. An upper frame which constitutes the upper rotating body has a base plate and a floor plate provided spacedly above the base plate. The construction machine further has a plurality of hydraulic actuators, a plurality of control valves for controlling the actuators each individually, a plurality of operating valves for operating the control valves each individually, an operation pattern switching valve for switching combination patterns of the operating valves and the control valves from one to another, and an operator's seat installed over the upper frame through a seat frame.

The operation pattern switching valve is disposed in a stand-up attitude in an underfloor space which is formed between the base plate and the floor plate at a position near either the right or left foot of an operator sitting on the operator's seat. An operating lever for switching operation is provided on an upper surface side of the operation pattern switching valve. The operating lever is configured so as to be manually operable from an operation port which is formed so as to be open to the floor plate. The upper surface side of the operation pattern switching valve, which includes the operating lever, is inclined forwardly downward in a facing relation to the operation port.

According to the present invention, in the underfloor space near either the right or left foot of the operator sitting on the operator's seat, the operation pattern switching valve is inclined forwardly downward so that its upper surface side including the operating lever faces the operation port, the upper surface of the switching valve, which includes the operating lever, can be located at a position easy to operate and easy to be seen despite the mounting position on a lower surface side of the switching valve being an inner position near the seat frame as in THE RELATED ART.

That is, although the operation pattern switching valve is installed at a hidden underfloor position, the switching operation of the switching valve and confirmation of a switching position thereof can be done easily in a relaxed attitude free of stress.

Besides, it is not necessary to expand the valve accommodating space upward. Moreover, such an extra part for covering the projecting portion of the operation pattern switching valve as in the configuration disclosed in Japanese Patent Laid-Open No. 2002-227249 is not needed, nor is it necessary to add a special lid for opening and closing the operation port to a side face of the upper frame which is required in case of installing the switching valve horizontally. Thus, such an inconvenience as the projecting portion becoming an obstacle to washing the machine body or the space near the operator's feet being reduced does not occur at all.

As a result of inclining the operation pattern switching valve forwardly downward there accrues an advantage that water sprinkled over the switching valve when washing the machine body flows down rapidly by the inclination of the upper surface of the valve, resulting in the water becoming difficult to stay particularly on a sealing member and its mounted portion, whereby it is possible to prevent the occurrence of rust.

DESCRIPTION OF THE PREFERRED EMBODIMENTS

A description will be given below about a small-sized hydraulic excavator called a mini-excavator as an example of the construction machine according an embodiment of the present invention.

Figure 8:
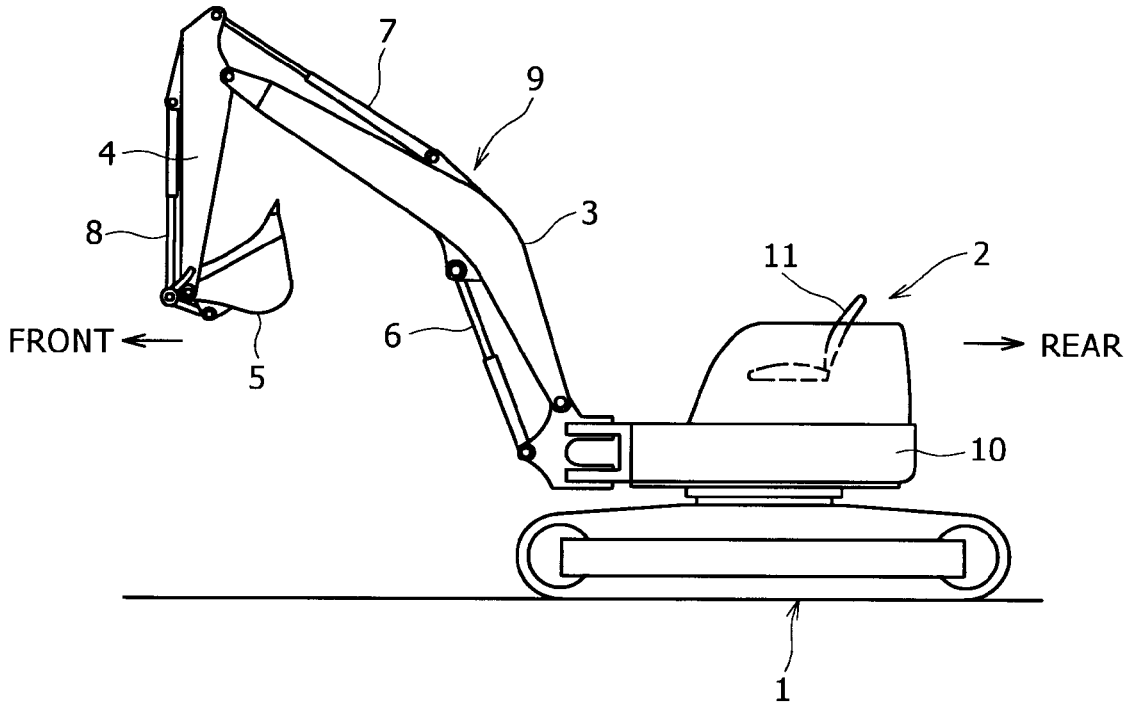
FIG. 8 is a schematic side view of a small-sized hydraulic excavator.

As shown in FIG. 8, the hydraulic excavator includes a crawler type lower traveling body 1, an upper rotating body 2 mounted on the lower traveling body 1 rotatably about a vertical axis, and a working attachment 9 attached to a front portion of the upper rotating body 2, the working attachment 9 comprising boom 3, arm 4, bucket 5 and hydraulic actuators (boom cylinder, arm cylinder, bucket cylinder) 6, 7, 8 for actuating them.

On an upper frame 10 of the upper rotating body 2 are mounted an operator's seat 11, various operating devices (not shown), as well as an engine and associated devices.

The embodiment of the present invention will be described below with reference to FIGS. 1 to 7.

A basic configuration of this embodiment, i.e., the following points, are the same as in THE RELATED ART.

(i) The upper frame 10 is made up of a base plate 12, a floor plate 13 disposed spacedly above the base plate 12, and a deck cover 14. As the case may be, the deck cover 14 may be designated a side cover and a front cover in a divided manner.

(ii) The operator's seat 11 is mounted through an operator's seat frame 17 over an upper surface of a rear portion of the upper frame 10 and an engine room 18 is formed under the operator's seat 11. An engine (not shown) and various devices (only a hydraulic oil tank 19 and a hydraulic pump 20 are shown) are installed within the engine room 18.

(iii) A valve accommodating space 21 is formed in an underfloor position on the left side of a front portion of the upper frame 10, namely, on the left or right side between the base plate 12 and the floor plate 13, and a control valve unit 22 comprising in a united state a plurality of hydraulic pilot switching type control valves for controlling hydraulic actuators each individually is accommodated within the valve accommodating space 21. The control valve unit 22 is mounted to the upper frame base plate 12 through a unit base 22*a*, and the control valves are operated by operating valves (so-called remote-controlled valves) (not shown) disposed around the operator's seat 11.

Figure 4:
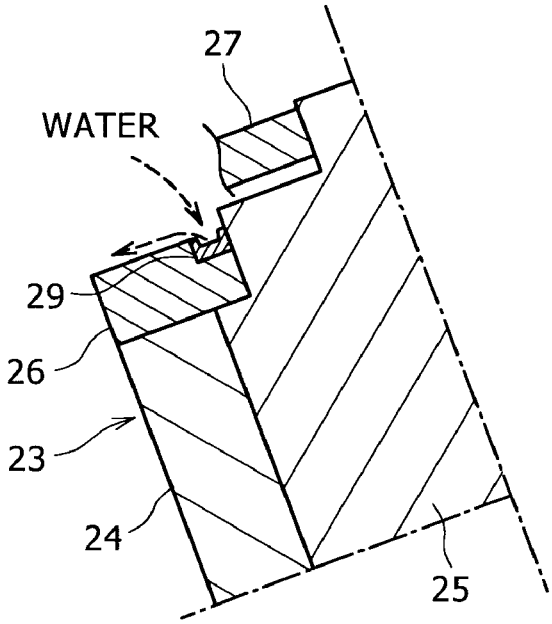
FIG. 4 is a partial enlarged sectional view of an operation pattern switching valve used in the embodiment.

(iv) An operation pattern switching valve 23 for selecting a combined operating valve—control valve pattern from among plural such combined patterns in accordance with an operator's desire is installed in a stand-up attitude within the valve accommodating space 21 at a position behind the control valve unit 22, i.e., at an underfloor position near the left or right foot of the operator sitting on the operator's seat 11. In FIG. 4, the numeral 29 denotes a sealing member for sealing between a cover 26 and a shaft 25.

(v) The operation pattern switching valve 23 comprises a cylindrical body 24, a shaft 25 fitted into the body 24 rotatably about a vertical axis, upper and lower covers 26 (only the upper cover is shown), and an operating lever 27 attached to an upper end of the shaft 25.

(vi) An operation port 30 is formed on the left side of a rear portion of the floor plate 13, and when the operator inserts his or her hand into the operation port 30 and turns the operating lever 27 by the hand, there is performed a pattern switching operation of the operation pattern switching valve 23.

Figure 1:
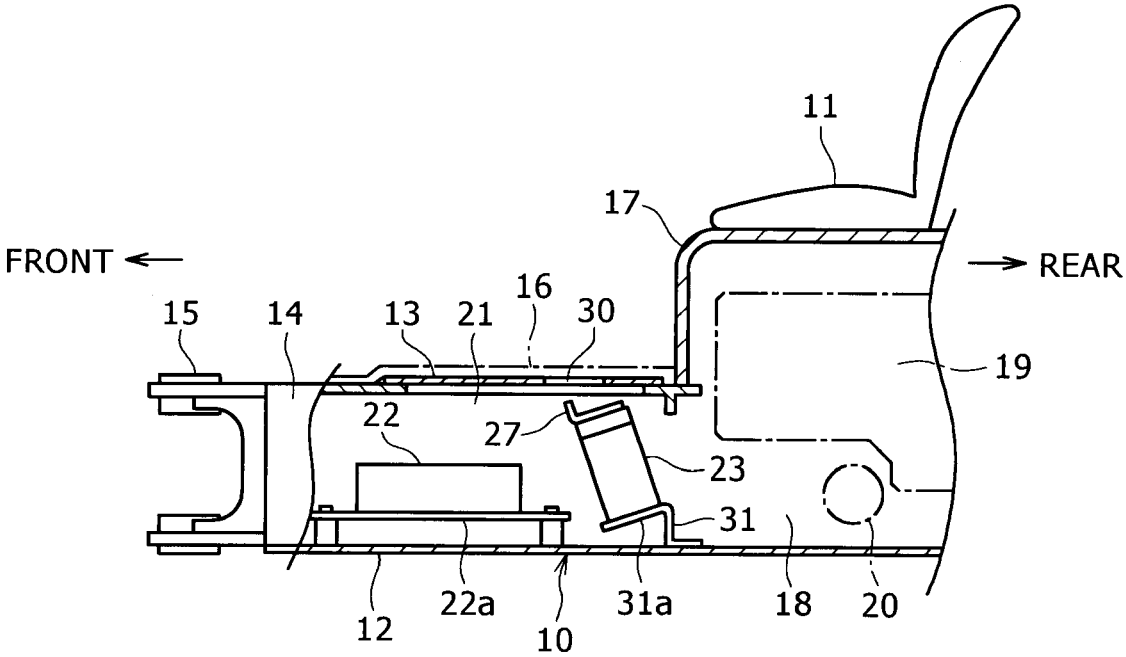
FIG. 1 is a partially sectional side view of an upper frame of a small-sized hydraulic excavator according to an embodiment of the present invention.

In FIG. 1, the numeral 15 denotes an attachment mounting portion to which the working attachment 9 is attached and numeral 16 denotes a floor mat laid over the floor plate 13. The operation port 30 is covered with the floor mat 16. The floor mat is turned up when an operation is to be performed, whereby the operation port 30 becomes open.

In this embodiment, the operation pattern switching valve 23 is inclined forwardly downward in a state in which its upper surface side including the operating lever 27 faces the operation port 30. Its lower surface is secured to the upper frame base plate 12 via a bracket 31.

The mounting position of the lower surface of the operation pattern switching valve is set at an inner position behind the control valve 22 and close to the operator's seat frame 17 as in THE RELATED ART. At this mounting position the forwardly declining angle of the operation pattern switching valve is set so that as wide an area of the upper surface side faces the operation port 30.

The bracket 31 has a switching valve mounting portion 31*a* to which the lower surface of the switching valve is mounted. As shown in the figure, the switching valve mounting portion 31*a* is formed so as to be inclined forwardly downward to match the forwardly downward inclination of the operation pattern switching valve 23.

According to this configuration, although the operation pattern switching valve 23 is mounted at an inner position under the floor as in THE RELATED ART, its upper surface can be set at a position ahead of that in THE RELATED ART and easy to operate and see from the operation port 30. More particularly, it is possible to obtain a state in which approximately the whole of the operating lever 27 faces the operation port 30 and approximately the whole of the switching position indicating portion can be seen from approximately just above the operation port 30.

Figure 2:
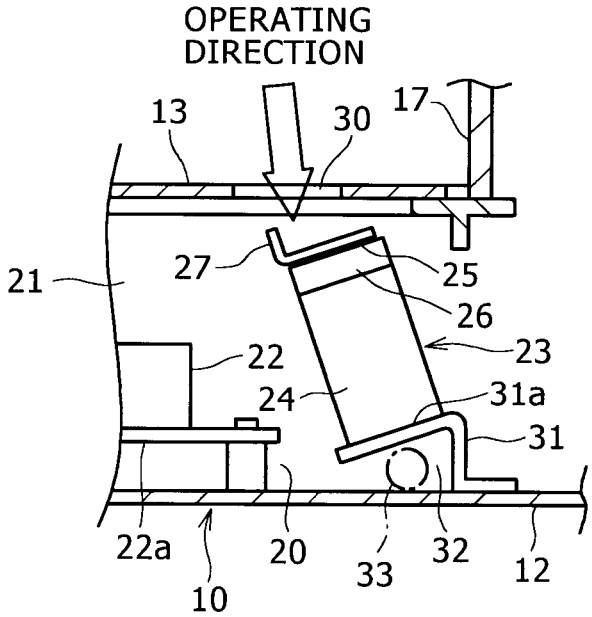
FIG. 2 is a partial enlarged view of FIG. 1.
Figure 3:
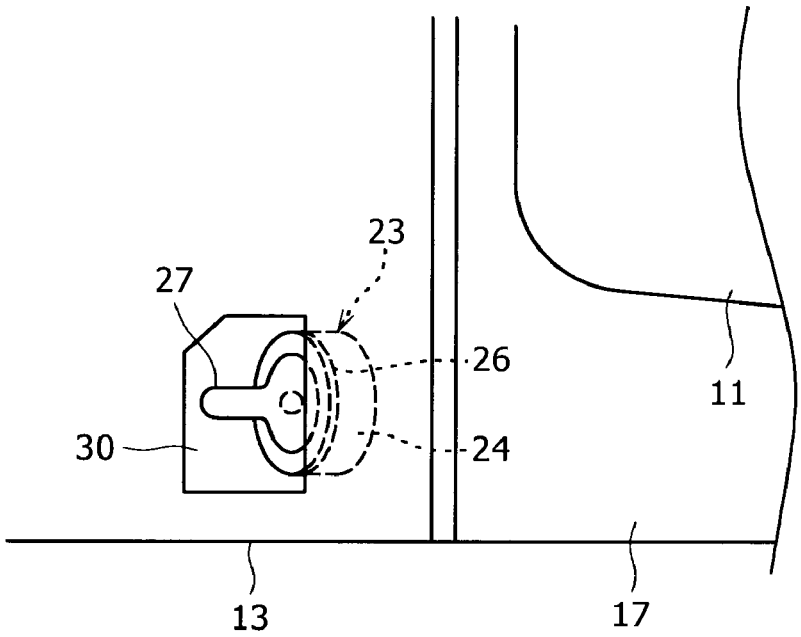
FIG. 3 is a partial plan view of FIG. 2.

Therefore, the operator can insert his or her hand from the operation port as indicated with an arrow in FIG. 2. 30 to a position approximately just under the same port and operate the operating lever 27 easily in such a slightly forwardly inclined attitude as his or her eyes lying approximately just above the operation port 30; besides, it is possible to check the switching position easily.

Moreover, it is not necessary to expand the valve accommodating space 21 upward and, unlike THE RELATED ART wherein the operation pattern switching valve 23 is projected above the floor, it is not necessary to use an extra part for covering the projecting portion. Further, it is not necessary to add a special lid for opening and closing the operation port to a side face of the upper frame which is required in case of installing the switching valve 23 horizontally. Thus, there does not occur such an inconvenience as the projecting portion being an obstacle to washing the machine body or the space near the operator's feet being reduced.

In addition, the following effects are obtained according to this embodiment.

(A) The upper portion of the operation pattern switching valve 23 tilts forwardly downward so as to get into a surplus space formed above the control valve unit 22, so that there is no fear of interference between the switching valve 23 and the control valve unit 22 (including pipes and the unit base 22*a*).

In other words, it becomes easier to install the operation pattern switching valve 23 in a forwardly downwardly inclined state and it is possible to take a sufficient angle of the inclination as required.

(B) Since the operation pattern switching valve 23 is inclined forwardly downward, water sprinkled over the switching valve 23 when washing the machine body flows down rapidly along the inclination of the upper surface of the switching valve as indicated with a broken-line arrow in FIG. 4 and is difficult to stay particularly on the sealing member 29 and its mounting portion. Consequently, it is possible to prevent the occurrence of rust.

(C) The switching valve mounting portion 31*a* of the bracket 31, which is for mounting the operation pattern switching valve 23 to the upper frame base plate 12, is inclined forwardly downward. Consequently, the spacing between the switching valve mounting portion 31*a* (at least the rear side thereof) and the upper frame base plate 12 can be made larger than in the prior art.

Accordingly, as shown in FIG. 2, a space 32 corresponding to the aforesaid spacing can be utilized effectively as a pipe passage for passing therethrough a hydraulic pipe 33 such as a pipe for connection between the control valves and the operating valves.

As the operating lever 27 is rotated about the center of the body by an external operation as noted above, the operation pattern switching valve 23 is switched from one position to another among plural positions and is fixed (held) immovably at the switched position. The structure for fixing the operating lever 27 to each position will be described below with reference to FIGS. 5A to 7.

The operating lever 27 has a disc portion 33 and an L-shaped handle 34 is projectingly provided on part of the outer periphery of the disc portion 33. Further, U-shaped notches 35 as screw passing holes (the same number as the switching positions, four in the illustrated example) are formed in the outer periphery edge of the disc portion 33 at circumferential intervals corresponding to the intervals of the switching positions while extending through the disc outer periphery edge portion vertically.

Figure 5A:
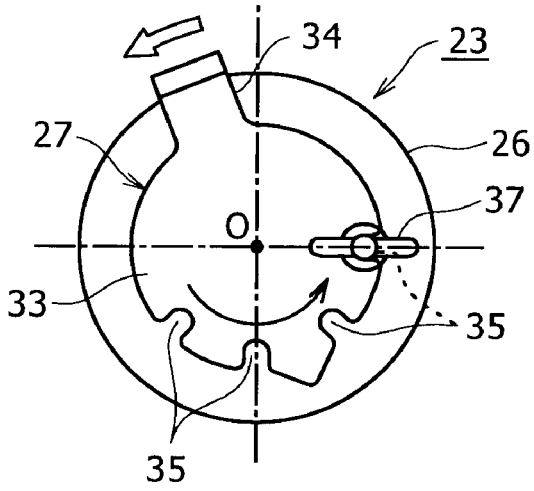
FIGS. 5A and 5B are plan views of the operation pattern switching valve as seen from just above at two switching positions.
Figure 5B:
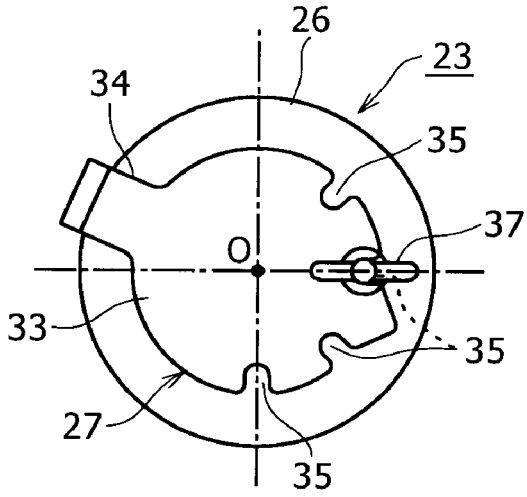
Figure 6:
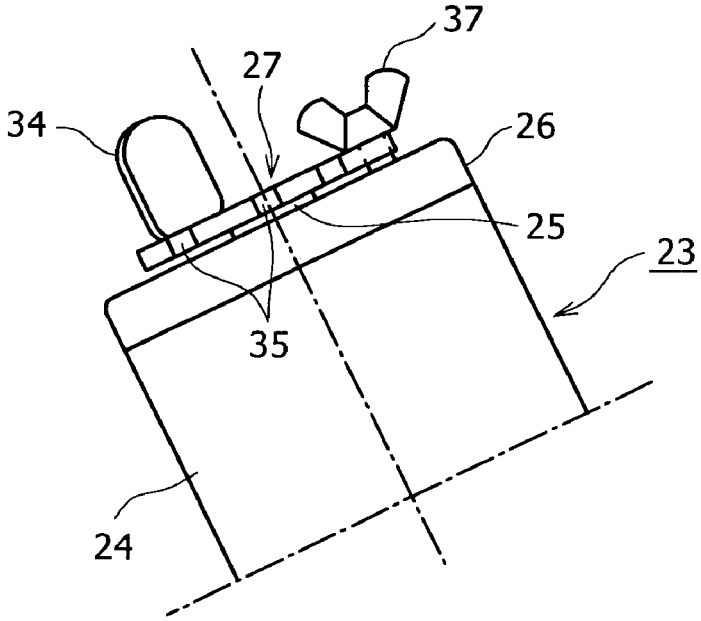
FIG. 6 is a partial side view of the switching valve.

On the other hand, a screw hole 36 for conforming to one of the notches 35 at each switching position are formed in the upper side cover 26 and, as shown in FIGS. 5A and 5B, a set screw (thumbscrew) 37 is threaded into the screw hole 36 at any of the switching positions through the associated notch 35, whereby the operating lever 27 is fixed to the selected switching position.

The operation pattern switching valve 23 is inclined forwardly downward. Therefore, in a screwing or unscrewing operation for the set screw 37, the set screw 37 is apt to fall from the upper surface of the switching valve 23 along the inclination due to a handling error such as, for example, separation of the operator's hand from the set screw 27 at the beginning of the screwing operation or at the end of the unscrewing operation.

Figure 7A:
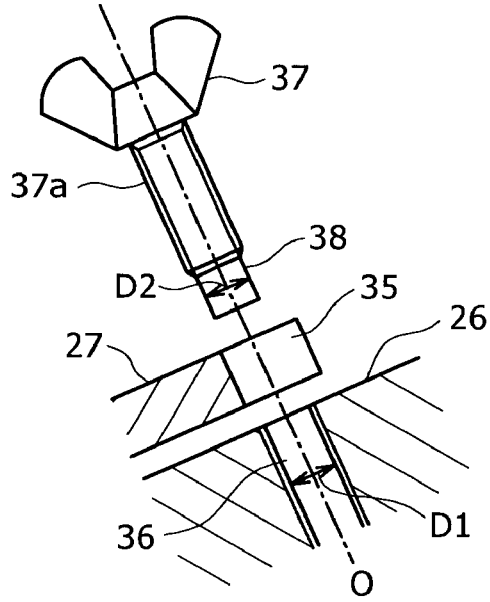
FIGS. 7A to 7C are partial sectional views showing a state before fixing an operating lever of the operation pattern switching valve to a switching position, a fixed state thereof, and a released state thereof, respectively, with respect to a structure for performing such a fixing operation.
Figure 7B:
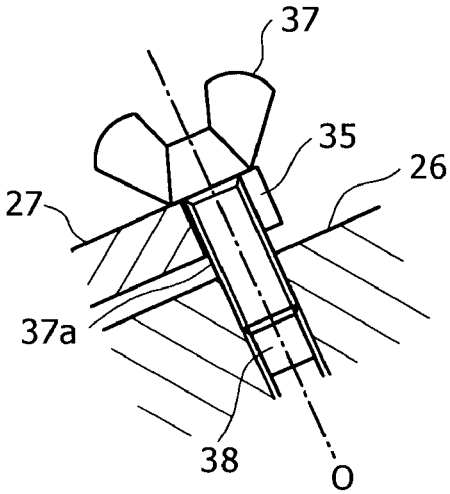
Figure 7C:
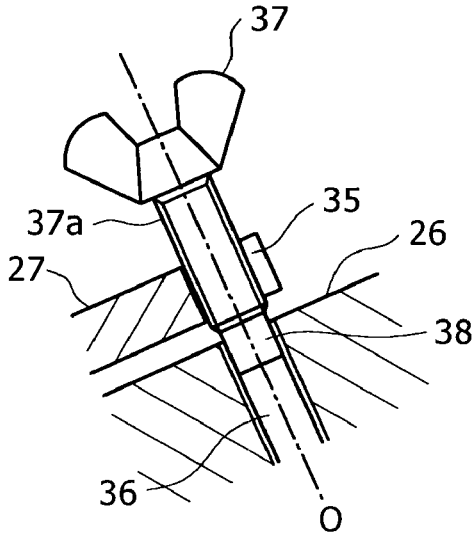

In this embodiment, as an anti-fall measure, a holding shaft portion 38 as a screw-free shaft portion is extended from a front end of a shaft portion 37*a* of the set screw 37, as shown in FIGS. 7A to 7C.

The diameter D2 of the holding shaft portion 38 is set at a value smaller (slightly smaller) than the inside diameter D1 of the screw hole 36.

Consequently, until the shaft portion 37*a* is threadedly fitted in the screw hole 36 when screwing the set screw 37 and after disengagement of the shaft portion 37*a* from the screw hole 36 when unscrewing the set screw 37, the holding shaft portion 38 is fitted in the screw hole 36 and holds the set screw 37, as shown in FIG. 7C.

Thus, there is no fear of falling of the set screw 37 from above the switching valve 23 due to a handling error.

Further, when screwing the set screw 37 into the screw hole 36, the holding shaft portion 38 functions to guide the shaft portion 37*a* into the screw hole 36, as shown in FIGS. 7A and 7B. Consequently, the screwing operation from the narrow operation port 30 becomes easier.

Other Embodiments (1) As the set screw 37 there may be used a screw other than the thumbscrew, e.g., a screw having a head portion of a larger diameter or a screw having been subjected to knurling so as to be easily turned manually. Moreover, it is not only limited to the screw that may be turned manually, but also it may be used a screw operated with tool like a hexagonal screw.

(2) The notches 35 as screw passing holes formed in the operating lever 27 may be substituted by through holes and the set screw 37 may be threaded into the screw hole 36 through any of the through holes. According to this configuration there accrues an advantage that even in a disengaged state of the holding shaft portion 38 of the set screw 37 from the screw hole 36, it is possible to prevent falling of the screw 37 if the holding shaft portion stays within the through hole.

(3) Although in the above embodiment a description has been given about the case where both control valve unit 22 and operation pattern switching valve 23 are disposed side by side in front and rear positions under the floor near the left foot of the operator, the present invention is applicable also to the case where one or both of the control valve unit and the operation pattern switching valve are installed under the floor near the right foot of the operator.

Even in the case where the operation pattern switching valve 23 is installed separately from the control valve unit 22, it is possible to obtain the same effects as above because the situation that the switching valve 23 is compelled to be installed at an inner position does not change from the standpoint of device layout as noted previously.

(4) The present invention is suitable for the small-sized hydraulic excavator described in the above embodiment, but is basically applicable widely to other construction machines having similar configurations and problems.

Although the invention has been described with reference to the preferred embodiments in the attached figures, it is noted that equivalents may be employed and substitutions made herein without departing from the scope of the invention as recited in the claims.

We claim:

1. A construction machine comprising:

a lower traveling body;

an upper rotating body mounted on said lower traveling body rotatably about a vertical axis and comprising an upper frame, said upper frame having a base plate and a floor plate disposed spacedly above said base plate; a plurality of hydraulic actuators;

a plurality of control valves for controlling said hydraulic actuators each individually;

a plurality of operating valves for operating said control valves each individually;

an operation pattern switching valve for switching combination patterns of said operating valves and said control valves from one to another;

an operator's seat mounted over said upper frame through a seat frame, said operation pattern switching valve being installed in a stand-up attitude within an underfloor space, said underfloor space being formed between said base plate and said floor plate at a position near the right or left foot of an operator sitting on said operator's seat; and an operating lever for a switching operation disposed on an upper surface side of said operation pattern switching valve, said operating lever is configured so as to be manually operable from an operation port formed, said operation port being formed so as to be open to said floor plate, said operation pattern switching valve being inclined forwardly downward so that an upper surface side thereof including said operating lever faces said operation port.

2. A construction machine according to claim 1, wherein a control valve unit comprising said plural control valves is disposed ahead of said operation pattern switching valve within said underfloor space.

3. A construction machine according to claim 1, wherein said operation pattern switching valve is mounted to the base plate of said upper frame through a bracket, said bracket having a switching valve mounting portion for mounting a lower surface of said operation pattern switching valve, said switching valve mounting portion being inclined forwardly downward.

4. A construction machine according to claim 1, wherein said operation pattern switching valve is configured so as to be switched from one switching position to another among a plurality of switching positions by a rotating operation of said operating lever and has a set screw for fixing said operating lever to any of said plural switching positions, and a screw-free holding shaft portion is extended from a front end of a shaft portion of said set screw, said screw-free holding shaft portion having a diameter smaller than the inside diameter of a screw hole for threaded insertion therein of said set screw.

* * * * *